US006840253B2

(12) United States Patent
Ma

(10) Patent No.: US 6,840,253 B2
(45) Date of Patent: Jan. 11, 2005

(54) SHADE ROTATING DEVICE OF SIDE POST UMBRELLA

(76) Inventor: Joen-Shen Ma, 12F, No. 578, Kwang Fu South Road, Taipei (TW)

( * ) Notice: Subject to any disclaimer, the term of this patent is extended or adjusted under 35 U.S.C. 154(b) by 281 days.

(21) Appl. No.: 10/266,616

(22) Filed: Oct. 9, 2002

(65) Prior Publication Data

US 2004/0069333 A1 Apr. 15, 2004

(51) Int. Cl.[7] ..... A45B 11/00

(52) U.S. Cl. ..... 135/20.1; 135/20.3; 135/21; 135/155; 362/18; 362/102

(58) Field of Search ..... 135/20.1, 20.3, 135/21, 90, 98, 16, 115; 362/18, 102, 577, 449; 248/515, 520

(56) References Cited

U.S. PATENT DOCUMENTS

| | | | | | |
|---|---|---|---|---|---|
| 2,605,778 | A | * | 8/1952 | Clapper | 135/20.1 |
| 2,905,187 | A | * | 9/1959 | Croce | 135/20.1 |
| 3,851,164 | A | * | 11/1974 | Intrator | 362/18 |
| 5,735,302 | A | * | 4/1998 | Saliva | 135/20.1 |
| 5,871,024 | A | * | 2/1999 | Vanderminden, Sr. | 135/20.1 |
| 6,014,980 | A | * | 1/2000 | Glatz | 135/20.1 |
| 6,152,156 | A | * | 11/2000 | Tung | 135/21 |
| 6,220,261 | B1 | * | 4/2001 | Glatz | 135/20.3 |

FOREIGN PATENT DOCUMENTS

| | | | |
|---|---|---|---|
| EP | 1042973 | * | 4/2000 |
| JP | 2-34103 | * | 2/1990 |

* cited by examiner

*Primary Examiner*—Winnie Yip
(74) *Attorney, Agent, or Firm*—Rosenberg, Klein & Lee

(57) ABSTRACT

A side post umbrella includes a side post to which a side arm is mounted by an arm retainer that is a tubular member receiving an end of the side arm therein. A rib skeleton is hung on the side arm and supports a shade. A shade rotating device is provided for rotating the side arm and thus the shade, including a cylinder rotatably received in the arm retainer and fixed to the side arm to be rotatable in unison therewith. A drive bar is pivotally connected to the cylinder for manually rotating the cylinder. A latch bar having a latch pin is movable with respect to the cylinder between a latched position where the latch pin engages a securing plate to secure the side arm and thus the shade at a corresponding angular position and a released position where the latch pin disengages the securing plate to allow for free rotation of the side arm and the shade. A helical spring is arranged between the latch bar and the cylinder to bias the latch pin toward the latched position. The drive bar is pivoted to the latch bar. The drive bar and the pivotal connection between the drive bar and the cylinder form a leverage that allows for manually driving the latch bar against the helical spring to release the latch pin. The securing plate may define a plurality of slots for selectively engageable by the latch pin to secure the shade at different angular positions.

5 Claims, 5 Drawing Sheets

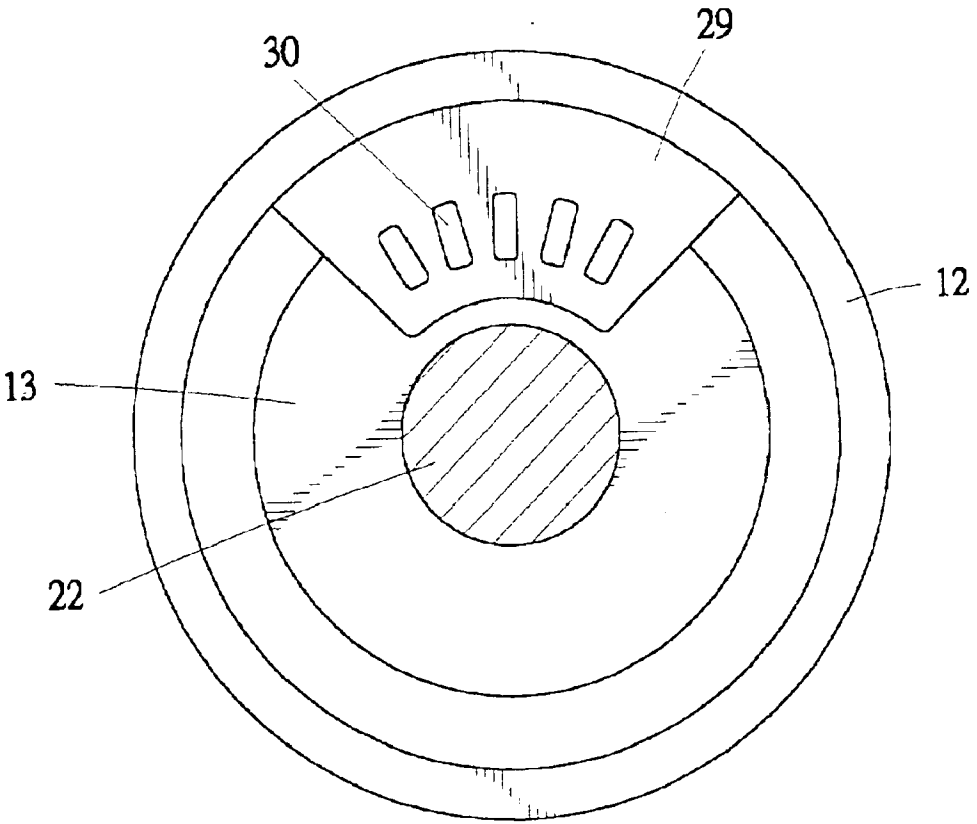
FIG.5(FIG.3A-A')

SHADE ROTATING DEVICE OF SIDE POST UMBRELLA

BACKGROUND OF THE INVENTION

1. Field of the Invention

The present invention generally relates to a side post umbrella comprising a shade supported on a side post by a cantilever type side arm, and in particular to a device for rotating the shade of the side post umbrella.

2. The Related Art

A side post umbrella comprises an upright side post having a lower end mounted to a solid surface or a deck and an upper end from which a side arm transversely extends for hanging a shade on a free end of the side arm. A shade is supported on a rib skeleton comprised of ribs and stretchers. The ribs are pivoted to a crown that is hung under the free end of the side arm. The stretchers have opposite ends respectively pivoted to a runner and the corresponding ribs. A rope-pulley system is employed to move the runner toward/away from the crown for stretching/releasing the ribs to open/close the shade. Since no interior pole or central post is included in the rib skeleton, the space below the shade can be fully exploited.

Conventionally, the side post is made swivelable for moving the shade to cover different area in accordance with the movement of the sun in order to provide effective shading of the blazing sunlight. However, the shade itself is not rotatable with respect to the side arm for further effecting shield of sun light from an angled direction.

Thus, it desired to provide a shade rotating device for a side post umbrella for overcoming the above problems.

SUMMARY OF THE INVENTION

An object of the present invention is to provide a side post umbrella having a shade rotating device for rotating a shade of the umbrella about a side arm from which the shade depends.

Another object of the present invention is to provide a shade rotating device for a side post umbrella that allows a shade of the side post umbrella to be selectively positioned at different angular positions.

To achieve the above objects, in accordance with the present invention, there is provided a side post umbrella comprising a side post to which a side arm is mounted by an arm retainer that is a tubular member receiving an end of the side arm therein. A rib skeleton is hung on the side arm and supports a shade. A shade rotating device is provided for rotating the side arm and thus the shade, comprising a cylinder rotatably received in the arm retainer and fixed to the side arm to be rotatable in unison therewith. A drive bar is pivotally connected to the cylinder for manually rotating the cylinder. A latch bar having a latch pin is movable with respect to the cylinder between a latched position where the latch pin engages a securing plate to secure the side arm and thus the shade at a corresponding angular position and a released position where the latch pin disengages the securing plate to allow for free rotation of the side arm and the shade. A helical spring is arranged between the latch bar and the cylinder to bias the latch pin toward the latched position. The drive bar is pivoted to the latch bar. The drive bar and the pivotal connection between the drive bar and the cylinder form a leverage that allows for manually driving the latch bar against the helical spring to release the latch pin. The securing plate may define a plurality of slots for selectively engageable by the latch pin to secure the shade at different angular positions.

BRIEF DESCRIPTION OF THE DRAWINGS

The present invention will be apparent to those skilled in the art by reading the following description of a preferred embodiment thereof, with reference to the attached drawings, in which:

FIG. 5 is a cross-sectional view taken along line A-A' of FIG. 3.

DETAILED DESCRIPTION OF THE PREFERRED EMBODIMENT

Figure 1:
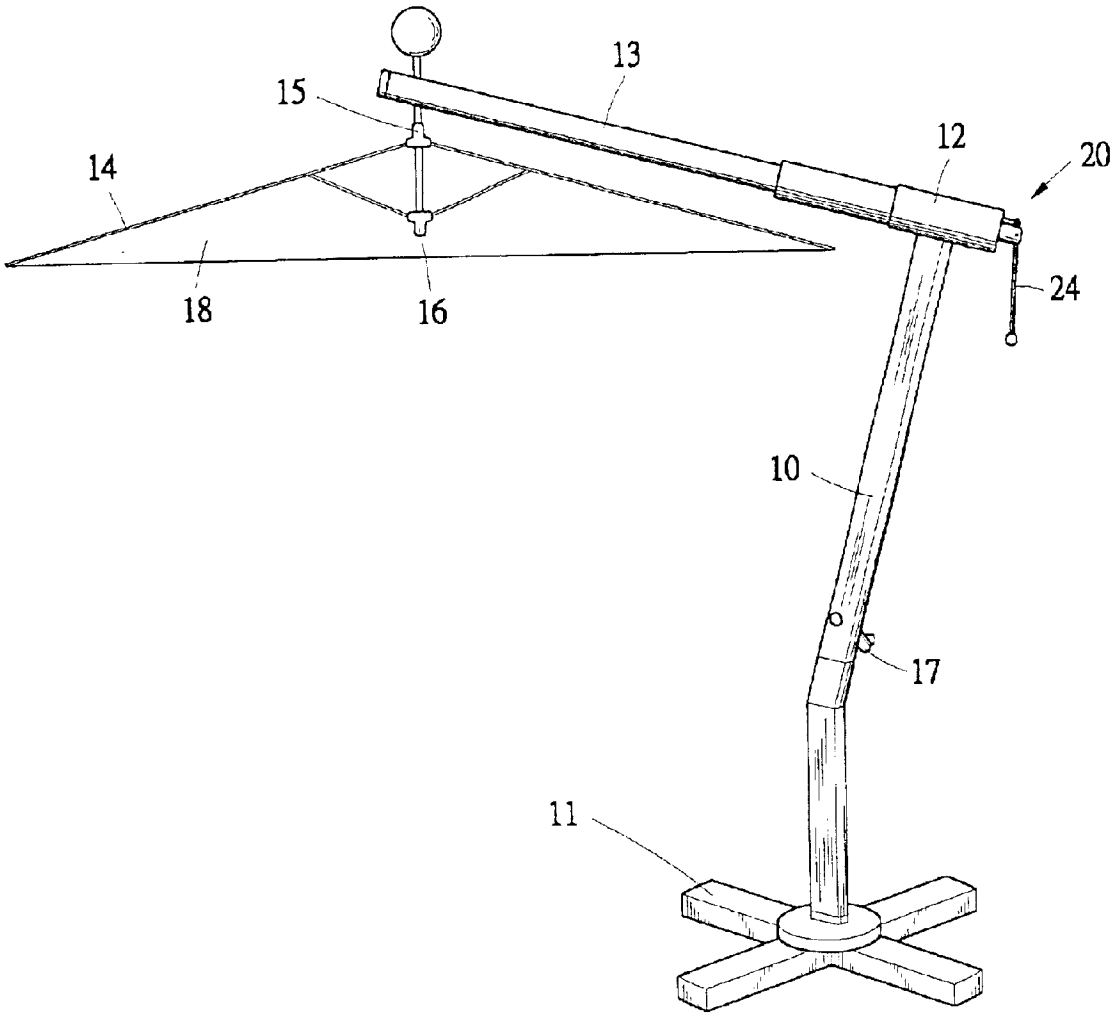
FIG. 1 is a schematic perspective view of a side post umbrella in which a shade rotating device in accordance with the present invention is embodied.

With reference to the drawings and in particular to FIG. 1, a side post umbrella in which a shade rotating device in accordance with the present invention is embodied is shown. The side post umbrella comprises a side post 10 substantially in an upright condition, having a lower end (not shown) mounted to a base 11. If desired, the base 11 can be a swivelable base that allows for rotation of the side post 10 about a vertical axis. A side arm 13 is mounted to an upper end of the side post 10 by an arm retainer 12. The side arm 13 extends from the arm retainer 12 in a substantially transverse direction thereby forming a cantilever arm having a remote free end. A shade 18 is mounted to and supported by a rib skeleton comprised of ribs 14 pivoted to a crown 15 that is hung on the free end of the side arm 13. The rib skeleton further comprises a runner 16 that is driven by a rope-pulley system (not shown) to move toward/away from the crown for moving the ribs 14 to open/close the shade 18. A manual control device 17 is provided on the side post 10 for manually operating the rope-pulley system to selectively open the shade 18.

Figure 2:
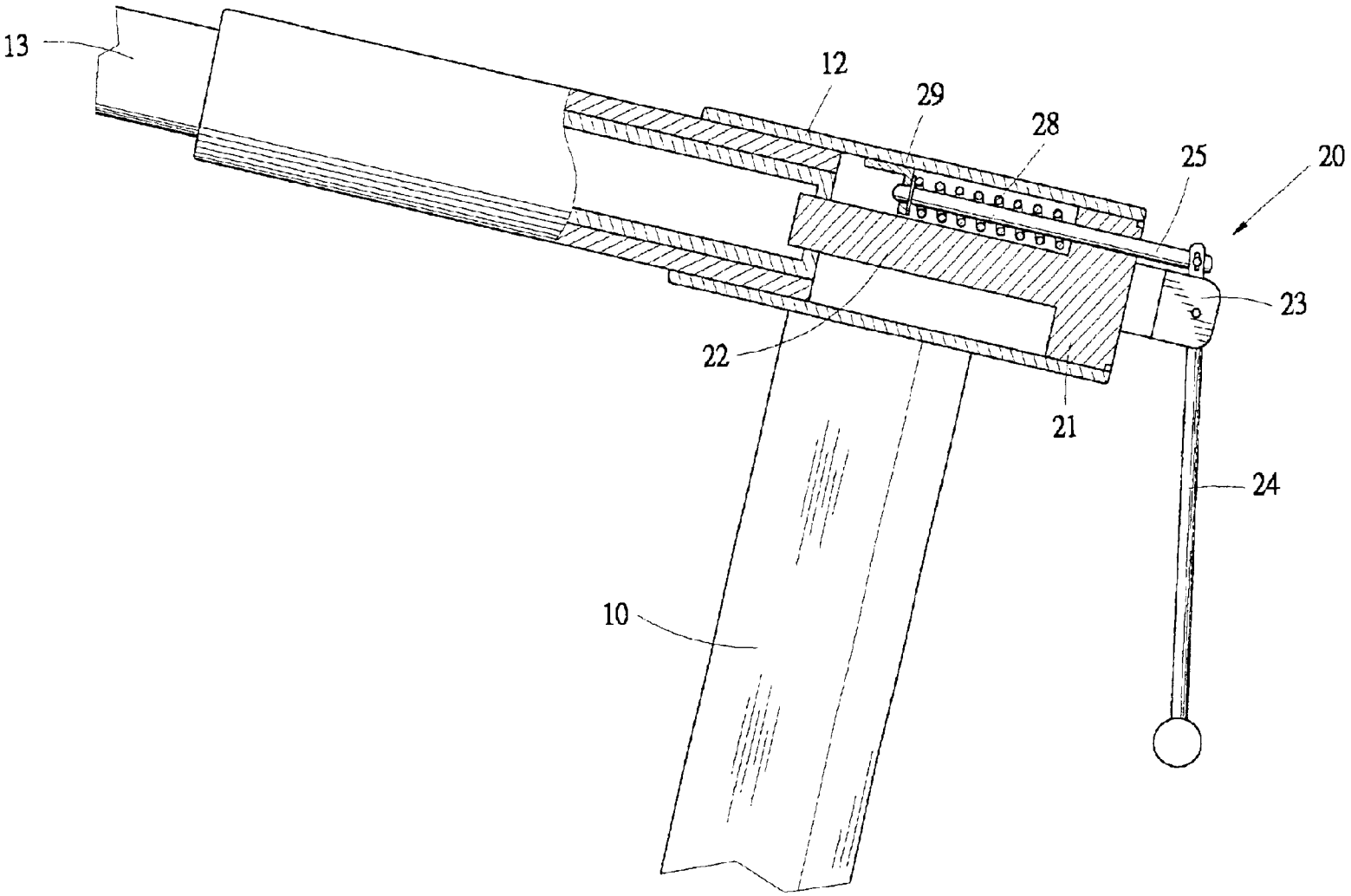
FIG. 2 is a cross-sectional view of the shade rotating device of the present invention in a latched condition.
Figure 3:
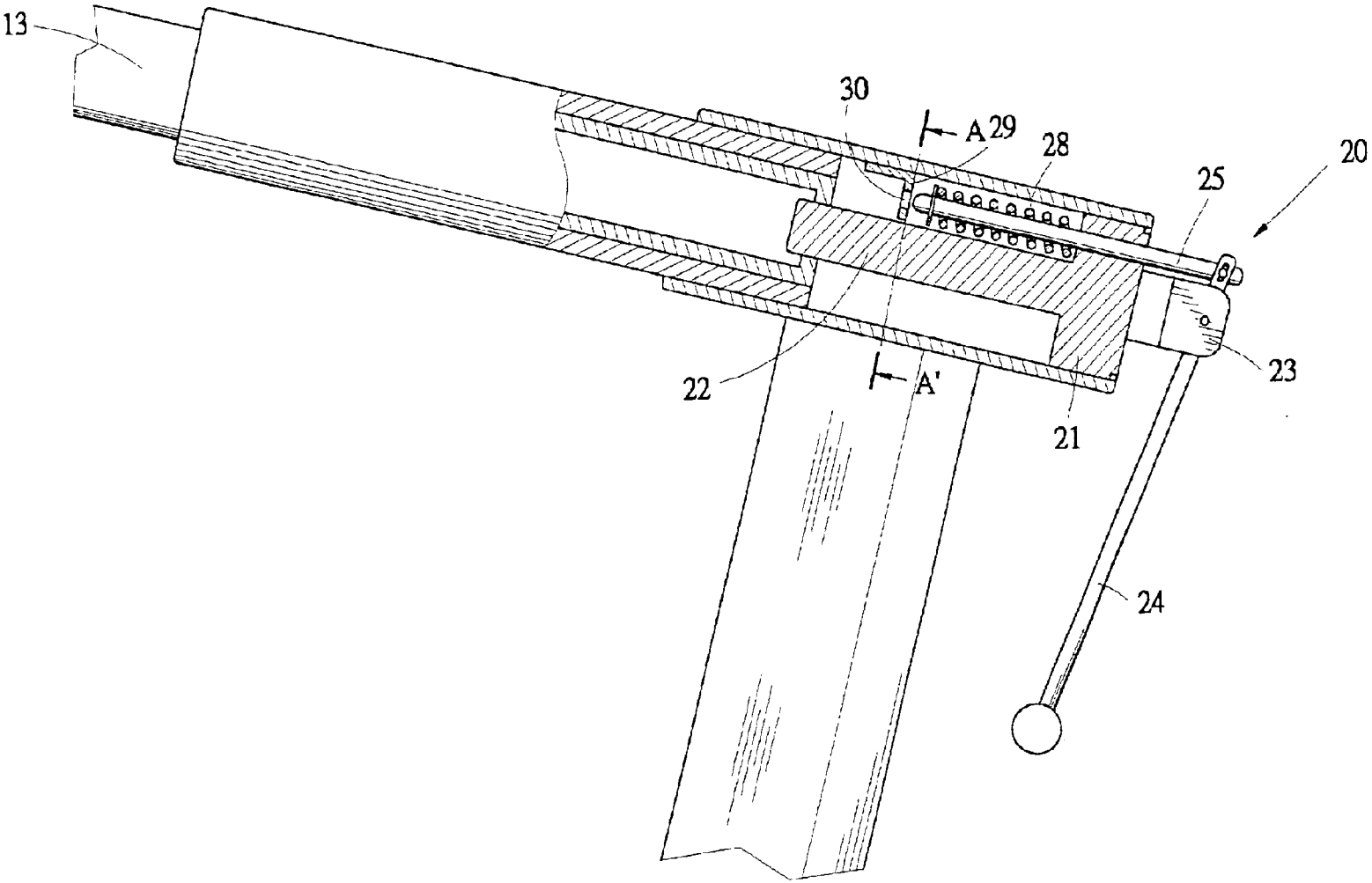
FIG. 3 is similar to FIG. 2 but showing the shade rotating device in a released and operable condition.

Also referring to FIGS. 2 and 3, the arm retainer 12 is made tubular into which a proximal end of the side arm 13 is fit. A shade rotating device constructed in accordance with the present invention, generally designated with reference numeral 20, comprises a cylinder 21 rotatably received in the arm retainer 12 and having an elongated, axially-extending projection 22. The proximal end of the side arm 13 is fixed to a free end of the projection 22 and is thus rotatable in unison therewith whereby rotating the cylinder 21 causes the side arm 13 to rotate about a central axis thereof. Thus, the shade 18 that is hung on the side arm 13 is rotated and changes angular position thereof with respect to the side arm 13.

A lug 13 is formed on the cylinder 21 and located outside the arm retainer 12. A drive bar 24 is pivotally connected to the lug 23 whereby by rotating the drive bar 24 about the central axis of the cylinder 21, the cylinder 21 and the side arm 13 are caused to rotate.

Figure 4:
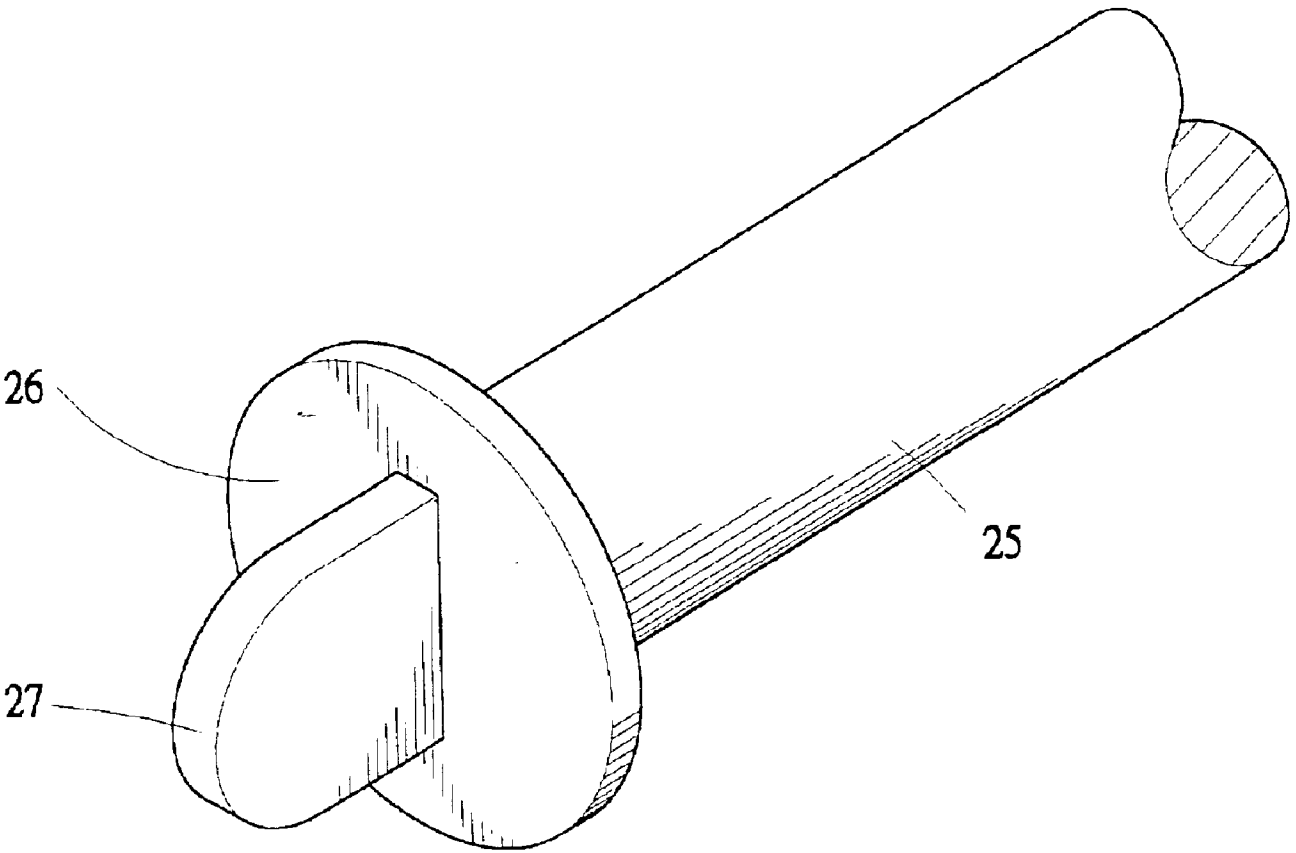
FIG. 4 is a perspective view of a remote free end of a latch bar of the shade rotating device of the present invention.

Also referring to FIG. 4, a latch bar 25 extends through a bore (not labeled) defined in the cylinder 21. The latch bar 25 has a front end forming a flange 26 to which a latch pin 27 is mounted. A helical spring 28 encompassing the latch bar 25 is supported between the flange 26 and the cylinder 21 to bias the latch bar 25 toward a latched position where the latch pin 27 engages a securing plate 29 (as shown in FIG. 2) to secure the cylinder 21 at a corresponding angular position thereby preventing free rotation of the side arm 13.

The latch bar 25 has a rear end pivoted to the drive bar 24 whereby the drive bar 24 and the pivotal connection between the drive bar 24 and the lug 23 form a leverage that allows a user to move the latch bar 25 against the helical spring 28 toward a released position whereby the latch pin 27 disengages from the securing plate 29 (as shown in FIG. 3) to allow for free rotation of the cylinder 21 and thus the side arm 13.

Also referring to FIG. 5, the securing plate 29 defines a number of angularly spaced slots 30 having an outline substantially complementary to the configuration of the latch pin 27 for snugly engaging the latch pin 27. The securing plate 29 is fixed to an inside surface of the arm retainer 12 whereby the latch pin 27 of the latch bar 25 is selectively engageable with any one of the slots 30 to secure the side arm 13 and thus the shade 18 at an angular position corresponding to the slot 30 engaged by the latch pin 27. By engaging the latch pin 27 of the latch bar 25 with different slots 30, the shade 18 can be positioned at different angular positions.

Preferably, the latch pin 27 comprises a flat portion having a rounded end for enhancing engagement thereof with the slot 30 of the securing plate 29.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. In a side post umbrella comprising a side post to which a side arm is mounted in a cantilevered manner and a shade mounted to and supported by the side arm, a shade rotating device mounted between the side arm and the side post for rotating the side arm and thus the shade, the shade rotating device comprising:

a tubular member mounted to the side post and receiving an end of the side arm therein;

a cylinder rotatably received in the tubular member and fixed to the end of the side arm to be rotatable in unison therewith;

a drive bar pivotally connected to the cylinder for manually rotating the cylinder;

a latch bar comprising a latch pin, the latch bar being movable with respect to the cylinder between a latched position and a released position, the latch bar being pivoted to the drive bar;

biasing means arranged between the latch bar and the cylinder to bias the latch bar toward the latched position; and a securing plate defining at least one slot whereby when the latch bar is at the latched position, the latch pin engages the slot to secure the cylinder and thus the side arm at an angular position defined by the slot and whereby when the latch bar is at the released position, the latch pin disengages from the slot to allow for rotation of the cylinder with respect to the tubular member;

wherein the drive bar and the pivotal connection between the drive bar and the cylinder forms a leverage that allows for manually driving the latch bar against the biasing means toward the released position.

2. The shade rotating device as claimed in claim 1, wherein the latch bar forms a flange and wherein the biasing means comprises a helical spring encompassing the latch bar and is supported between the flange and the cylinder.

3. The shade rotating device as claimed in claim 1, wherein the latch pin comprises a flat portion having a rounded end.

4. The shade rotating device as claimed in claim 1, wherein the slot has an outline substantially complementary to configuration of the latch pin for snugly engaging the latch pin therein.

5. The shade rotating device as claimed in claim 1, wherein the securing plate defines a plurality of slots respectively corresponding to different angular positions, the latch pin being selectively engageable with the slots to secure the side arm and thus the shade at different angular positions.

* * * * *